US005704413A

United States Patent [19]

Takasaki et al.

[11] Patent Number: 5,704,413

[45] Date of Patent: Jan. 6, 1998

[54] ROTARY-MOLD GRAVITY CASTING PROCESS

[75] Inventors: Norimasa Takasaki; Takashi Inagaki; Masayoshi Ohashi; Ryuichi Hanaoka, all of Wako, Japan

[73] Assignee: Honda Giken Kogyo Kabushiki Kaisha, Tokyo, Japan

[21] Appl. No.: 826,076

[22] Filed: Mar. 24, 1997

Related U.S. Application Data

[63] Continuation of Ser. No. 350,992, Nov. 29, 1994, abandoned.

[30] Foreign Application Priority Data

Nov. 30, 1993 [JP] Japan ..... 5-299552

[51] Int. Cl.[6] ..... B22D 35/04; B22D 41/04

[52] U.S. Cl. ..... 164/136; 164/336

[58] Field of Search ..... 164/136, 336, 164/337

[56] References Cited

FOREIGN PATENT DOCUMENTS

| | | | |
|---|---|---|---|
| 54-133427 | 10/1979 | Japan | 164/136 |
| 64-15267 | 1/1989 | Japan | 164/136 |
| 5-146861 | 6/1993 | Japan . | |

*Primary Examiner*—Kuang Y. Lin

*Attorney, Agent, or Firm*—Armstrong, Westerman, Hattori, McLeland & Naughton

[57] ABSTRACT

A molten metal is poured into and stored in a hopper in a rotary-mold gravity casting process, so that a small amount of the molten metal is allowed to flow out of the hopper into a runner to previously fill up the runner. A casting mold is rotated from this state, thereby causing the molten metal to be filled from the hopper into a cavity by a difference in height generated between the molten metal level in the hopper and the molten metal level in the casting mold. Thus, when the molten metal, once stored in the hopper, is filled into the cavity in the casting mold by rotating the casting mold, the inclusion of air can be prevented from being produced due to ruffling of the molten metal in the cavity.

4 Claims, 2 Drawing Sheets

ROTARY-MOLD GRAVITY CASTING PROCESS

This application is a continuation of application Ser. No. 08/350,992 filed Nov. 29, 1994, now abandoned.

BACKGROUND OF THE INVENTION

1. Field of the Invention

The present invention relates to a rotary-mold gravity casting process which comprises the steps of: preparing a casting mold including a hopper for pouring a molten metal to a runner connected to a cavity within the casting mold; pouring a predetermined amount of the molten metal into the hopper and storing the molten metal in the hopper; and turning the casting mold along with the hopper to pour the molten metal from the hopper into the cavity in the casting mold.

2. Description of the Prior Art

Such a rotary-mold gravity casting process is already known, as disclosed, for example, in Japanese Patent Application Laid-Open No. 146861/93.

In the prior art rotary-mold gravity casting process, when the molten metal is poured into the hopper, it is stored only in the hopper, and the runner in the casting mold is still maintained in an opened state. Then, the molten metal in the hopper is dropped from its surface side into the runner by turning the casting mold. Therefore, the inclusion of air, due to the ruffling or fretting of the molten metal, is liable to be produced in the cavity within the casting mold. Such an inclusion of air causes blow holes to be formed in a product.

SUMMARY OF THE INVENTION

Accordingly, it is an object of the present invention to provide a rotary-mold gravity casting process in which a molten metal can be filled into a cavity without occurrence of the ruffling, thereby easily producing a good quality product free from blow holes.

To achieve the above object, according to the present invention, there is provided a rotary-mold gravity casting process comprising the steps of: preparing a casting mold, including a hopper, for pouring a molten metal to a runner connected to a cavity within the casting mold; pouring a predetermined amount of a molten metal into the hopper and storing the molten metal in the hopper, and filling the runner with the molten metal flowing out of the hopper; and turning the casting mold, along with the hopper, to pour the molten metal from the hopper into the cavity in the casting mold by a difference in height generated between the molten metal level in the hopper and the molten metal level in the casting mold.

With the above process, only molten metal of a good quality is passed into the mold cavity upon rotation of the casting mold. Consequently, it is possible to inhibit the ruffling of the molten metal in the cavity, thereby easily producing a good quality product free from blow holes.

The above, and other objects, features and advantages of the invention, will become apparent from the following description of a preferred embodiment taken in conjunction with the accompanying drawings.

BRIEF DESCRIPTION OF THE DRAWINGS

FIGS. 2A–2C are views for explaining steps of the casting process according to the present invention, wherein FIG. 2A shows the pouring and storing of a molten metal into the hopper, FIG. 2B shows the course of filing of the molten metal into a cavity by the rotation of the casting mold, and FIG. 2C shows the completion of filling of the molten metal into the cavity as a result of the lateral turning of the casting mold.

DESCRIPTION OF THE PREFERRED EMBODIMENT

The present invention will now be described by way of a preferred embodiment of the present invention with reference to the accompanying drawings.

Figure 1:
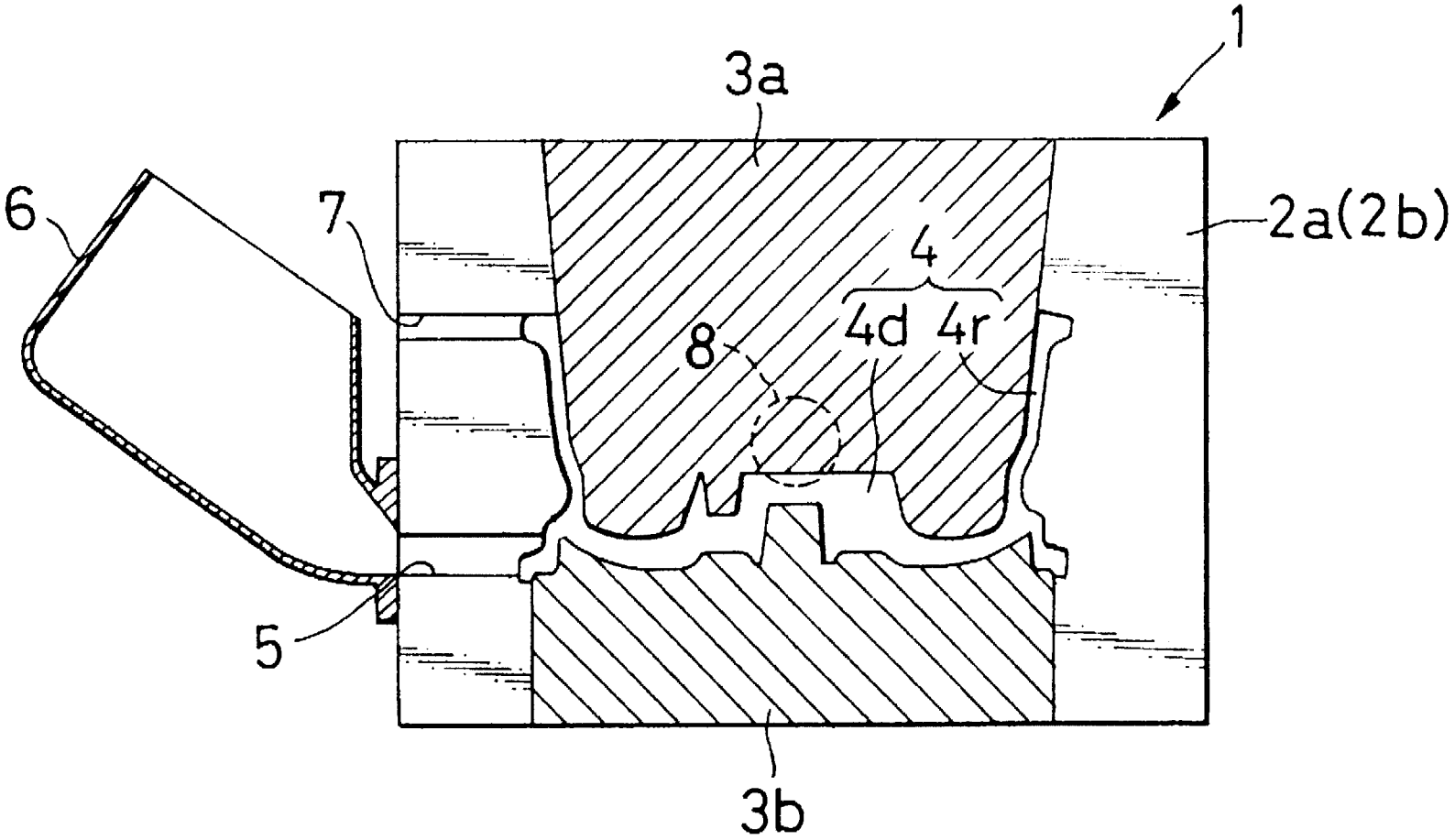
FIG. 1 is a vertical sectional view of a casting mold, including a hopper for use in a casting process, according to the present invention.

FIG. 1 shows a casting mold for producing a wheel made of aluminum alloy for a vehicle, which is used in a rotary mold gravity casting process according to the present invention. The casting mold 1 includes a pair of outer dies **2*a* and 2*b* which are opened and closed in a diametrical direction of a wheel to be produced by casting (in a direction perpendicular to the plane of FIG. 1), and a pair of inner walls 3*a* and 3*b* which are opened and closed in an axial direction of the wheel (in a vertical direction as viewed in FIG. 1) and surrounded by the outer dies 2*a* and 2*b*, when the dies are closed. A cavity 4, which is defined within the casting mold 1 by closing the latter, includes a rim forming portion 4*r* and a disk forming portion 4*d*. The disk forming portion 4*d* is in communication with a location of the rim forming portion 4*r*** offset downwardly from an axially central portion of the latter.

A runner 5 is provided between mating surfaces of the outer dies **2*a* and 2*b* to extend radially outwardly from a lower end of the rim-forming portion 4*r* and open into outer surfaces of the outer dies 2*a* and 2*b*. A hopper 6 is mounted to the outer die 2*a* or 2*b* for pouring a molten metal into the runner 5. The hopper 6 has an internal bottom surface formed continuously with an inlet of the runner 5. A molten metal heat retaining means (not shown) such as an electric heater is provided in the hopper 6**.

A riser reservoir 7 is also provided between the mating surfaces of the outer dies **2*a* and 2*b* to extend parallel with the runner 5 from an upper end of the rim forming portion 4*r* and open into the outer surfaces of the outer dies 2*a* and 2*b***.

The casting mold 1 is provided with a pivot 8 having an axis which is perpendicular to the mating surfaces of the outer dies **2*a* and 2*b* and extends through the center of the cavity 4. The casting mold 1 is rotatably supported on a stationary frame (not shown) through the pivot 8**.

Figure 2A:
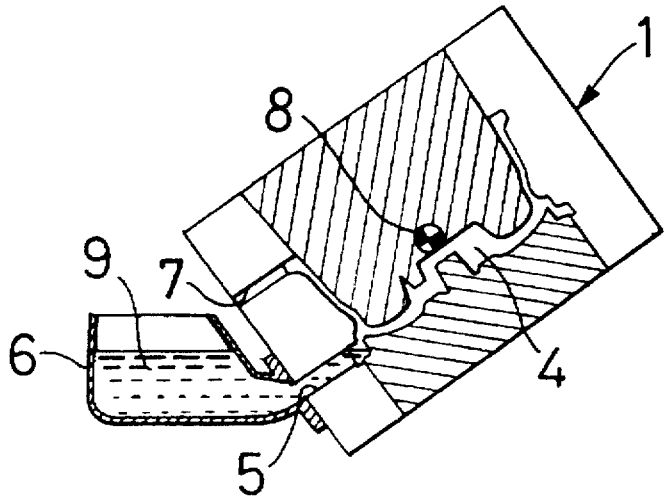

To cast a wheel for a vehicle using the above-described casting mold 1, the casting mold 1 is first fixed in an attitude inclined about the pivot 8 at an appropriate angle, e.g., at 35° from a horizontal position, as shown in FIG. 2A, so that the inlet of the runner 5, i.e., an opening into the hopper 6, is turned downwardly and located below the cavity 4, when the casting mold 1 has been closed. In this state, an aluminum alloy molten metal 9 is poured in a predetermined amount larger than the volume of the cavity 4 into the hopper 9 and stored therein. In this case, it is particularly important to flow the molten metal out of the hopper 6 to fill up the runner 5 beforehand.

Figure 2B:
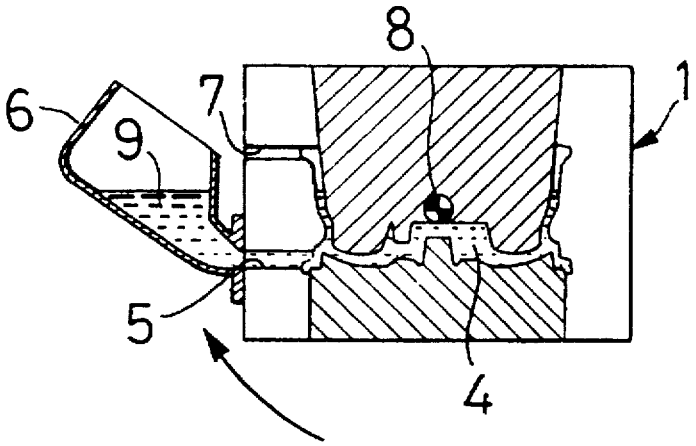
Figure 2C:
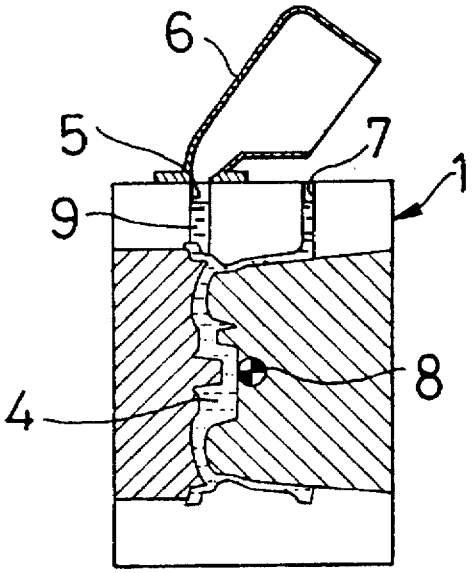

Then, as shown in FIGS. 2B and 2C, the casting mold 1 is gradually turned about the pivot 8, along with the hopper 6, so that the inlet of the runner 5 is directed upwardly. This causes the molten metal in the hopper 6 to be supplied from the bottom in the hopper 6 through the runner 5 into the cavity 4 by a difference in height generated between a molten metal level in the hopper 6 and a molten metal level in the casting mold 1. That is, the molten metal 9 is gradually filled into the cavity 4 in a manner that the molten metal level is urged upward with the turning movement of the casting mold 1. Therefore, the molten metal of a good quality, free from impurities, such as, oxides floating on the molten metal surface within the hopper 6, can be filled into the cavity 4 without inclusion of air. Moreover, the rising speed of the molten metal level in the cavity 4, i.e., the filling speed can be easily controlled by adjusting the rotational speed of the casting mold 1.

The internal bottom surface of the hopper 6 is of a shape continuous with the inlet of the runner 5 and therefore, the molten metal can be smoothly supplied from the hopper 6 to the runner 5 with the rotation of the casting mold 1 without generation of a turbulent flow.

If the casting mold 1 is rotated until the runner 5 and the riser reservoir 7 reach their uppermost positions, as shown in FIG. 2C, after the entire cavity 4 is filled with the molten metal 9, the molten metal level rises up to the riser reservoir 7. On the other hand, the hopper 6 is emptied with the runner 5 remaining filled up with the molten metal. The molten metal filling up the runner 5 and the riser reservoir 7 exhibits a feeding effect to the molten metal in the cavity 4. In other words, when the molten metal in the cavity 4 shrinks upon the solidification thereof, the molten metal in the runner 5 and the riser reservoir 7 is drawn into the cavity 4 to compensate for the shrinkage.

The casting mold 1 is fixed, for a predetermined time, in the rotated state shown in FIG. 2C to await the solidification of all the molten metal. Then, the casting mold 1 is opened, and an aluminum alloy wheel, as a product, is removed to complete one casting cycle. In this manner, a good quality wheel, free from blow holes, can be cast.

Although the process for casting the aluminum alloy wheel has been described above, it will be understood that the present invention is not limited thereto, and is applicable to the casting production of various products using other metals.

The terms and expressions which have been employed in the foregoing description are used as terms of description and not of limitation, and there is no intention, in the use of such terms and expressions, of excluding any equivalents of the feature shown and described or portions thereof, but it is recognized that various modifications are possible within the scope of the invention claimed.

What is claimed is:

1. A rotary-mold gravity casting process comprising the steps of:

preparing a casting mold having a cavity therewithin, a runner connected to the cavity and a hopper for pouring a molten metal fixed to the mold with its outlet connected to the runner;

pouring molten metal into said hopper in an amount sufficient to substantially fill the cavity while holding said casting mold and said hopper in a state wherein said molten metal, when in a stored condition in the hopper, fills said runner and prevents communication of said cavity with a space beyond the level of metal in said hopper; and then turning said casting mold along with the hopper from said state to pour the molten metal from the hopper through the runner into the cavity in the casting mold by a difference in height developed between the molten metal level in the hopper and the molten metal level in the casting mold.

2. A rotary-mold gravity casting process comprising the steps of:

preparing a casting mold having a cavity therewithin, a runner connected to the cavity, and a hopper for pouring a molten metal fixed to the mold and provided with an upper inlet and a lower outlet, said lower outlet of the hopper being connected to the runner;

pouring the molten metal into said hopper through said upper inlet while holding said hopper and said casting mold in a holding state wherein said molten metal poured into the hopper fills said runner and prevents communication of said cavity with a space beyond the level of metal in said hopper; and then turning said casting mold and the hopper from said holding state to pour the molten metal from the hopper into the cavity in the casting mold through the runner using a difference in height developed by the turning of said casting mold and said hopper between a molten metal level in the hopper and a molten metal level in the casting mold, while maintaining the runner filled with the molten metal.

3. A rotary-mold gravity casting process according to claim 2, wherein said outlet of the hopper is connected to an outside opening of the runner which is open at a lateral side portion of the casting mold, said runner having an inner end portion connected to said cavity, the method further comprising the step of keeping said inner end portion of the runner at a higher position than said outside opening of the runner in said holding state so as to permit an inner end of said molten metal to come around said inner end portion.

4. A rotary-mold gravity casting process according to claim 3, wherein said inner end portion of the runner is connected to a bottom portion of said cavity, the method further comprising the step of charging the molten metal into the cavity from said bottom portion of the cavity toward an upper side portion of the cavity.

* * * * *